US005382291A

United States Patent [19]

Olioso

[11] Patent Number: 5,382,291

[45] Date of Patent: Jan. 17, 1995

[54] APPARATUS FOR MAKING DECORATIONS ON TARRED MEMBRANES FOR SURFACE COVERING IN THE CONSTRUCTION INDUSTRY

[75] Inventor: Silvio Olioso, Castel D'Azzano, Italy

[73] Assignee: Index S.P.A. Technologie Impermeabili, Verona, Italy

[21] Appl. No.: 145,212

[22] Filed: Nov. 3, 1993

[30] Foreign Application Priority Data

Jul. 28, 1993 [IT] Italy ..... VR93A000060

[51] Int. Cl.[6] ..... B05C 1/00

[52] U.S. Cl. ..... 118/212; 118/244; 118/248; 118/249; 118/258; 427/197

[58] Field of Search ..... 118/212, 244, 248, 249, 118/258; 427/197

[56] References Cited

U.S. PATENT DOCUMENTS

| | | | |
|---|---|---|---|
| 455,271 | 6/1891 | Bormann | 118/212 |
| 1,222,594 | 4/1917 | Becker | 118/212 |
| 1,392,323 | 10/1921 | Goldberg | 118/212 |
| 2,559,879 | 7/1951 | Kalin | 118/212 |
| 3,360,393 | 12/1967 | Rhorer | 118/212 |
| 4,135,962 | 1/1979 | Sinclair et al. | 156/387 |
| 5,101,759 | 4/1992 | Hefele | 118/202 |

*Primary Examiner*—James C. Housel
*Assistant Examiner*—N. Bhat
*Attorney, Agent, or Firm*—Browdy and Neimark

[57] ABSTRACT

The decorations (6) made by the apparatus are realized by the use of solid particles (7) in the form of scales, sands or granules, which are deposited on and adhere to the hot tarred surface of the membrane (1). The apparatus includes at least one device for applying solid particles (formed by a rotating roller (10) or a rotating ring-wound continuous belt (14–17)or a rotatable plate (19)) provided with shapes (8) having a same shape as the final decorations (6) on the membrane (1) will have. The solid particles applying device is associated to a hopper (9) containing the solid particles (7) in such a way that the particles (7) fall by force of gravity from the outlet mouth of the hopper (9) onto the solid particles applying device and thence from the shapes (8) cut into the solid particles applying device onto the transiting membrane (1), forming the decorations (6) on the membrane (1).

11 Claims, 7 Drawing Sheets

APPARATUS FOR MAKING DECORATIONS ON TARRED MEMBRANES FOR SURFACE COVERING IN THE CONSTRUCTION INDUSTRY

BACKGROUND OF THE INVENTION

The invention relates to an apparatus for making monochromatic or polychromatic decorations on traditional-type waterproof tarred membranes, used for surface covering in the building industry.

Obviously the invention is only intended for use in connection with surfaces that will be on view, so it finds particular application on roof or terrace covering and the like.

Normally membranes used for such purposes, known as "self-protecting", are surface-treated with mineral grits, or plastic or metal scales, sands or granules, all of which protect the membranes from weathering caused above all by the sun's ultraviolet rays.

The invention is intended for application to membranes of the above-mentioned type which remain on view, and makes use of the above materials.

Hoppers are normally used to apply the layer of grit on the tarred membrane, usually in conjunction with a cylindrical roller having a smooth or slightly corrugated surface, which is positioned below the outlet mouth of the hopper and on the tarred membrane moving below it. The grit falls by force of gravity on to the roller and is conveyed by the latter on to the membrane, being distributed thereupon uniformly so as to form a protective layer. Using this method no decorative pattern on the membrane is possible.

The known system for making decorations on the surface of the membrane with grit envisages the use of one or more hoppers which are mobile transversally with respect to the advancement direction of the membrane. The hopper movement thus consists in a side-to-side movement while the grit is being laid by the hopper itself on to the underlying membrane. This is a system that exhibits a considerable drawback, however, since the only decorations possible are those deriving from a combination of the two straight movements of the membrane and at least one hopper, mutually perpendicular, so that the decorations produced are extremely rudimentary, consisting essentially in straight lines, zig-zags and serpentine patterns.

The principal aim of the present invention is to obviate the above drawbacks in the prior art by providing an apparatus which simply and economically makes it possible to create any kind of design on tarred membranes using solid particles.

SUMMARY OF THE INVENTION

This and other aims are attained by the apparatus for making decorations on tarred membranes for surface covering of buildings, the decorations being made by using solid particles, in the form of scales or sands or grit, which particles adhere to the tarred surface of the membranes, the apparatus includes at least one applicator means for applying solid particles and an impregnation bath of the membrane such that the membrane, travelling continuously along an advancement direction, defined as the direction from the impregnating bath to the solid particles applying means. The applicator means for applying solid particles exhibits outlines of the shapes which will be transferred on to the surface of the membrane. The means for applying solid particles is associated to at least one hopper containing the solid particles, so that the particles fall from the outlet mouth of the hopper and on to the solid particles applying means thereafter falling from the shapes cut in the solid particles applying means and on to the moving membrane, creating the desired decorations.

BRIEF DESCRIPTION OF THE DRAWINGS

Further characteristics and advantages of the present invention will better emerge from the detailed description that follows, of a preferred but non-exclusive embodiment here illustrated in the form of a non-limiting example in the accompanying drawings, in which.

DESCRIPTION OF THE PREFERRED EMBODIMENT

Figure 1:
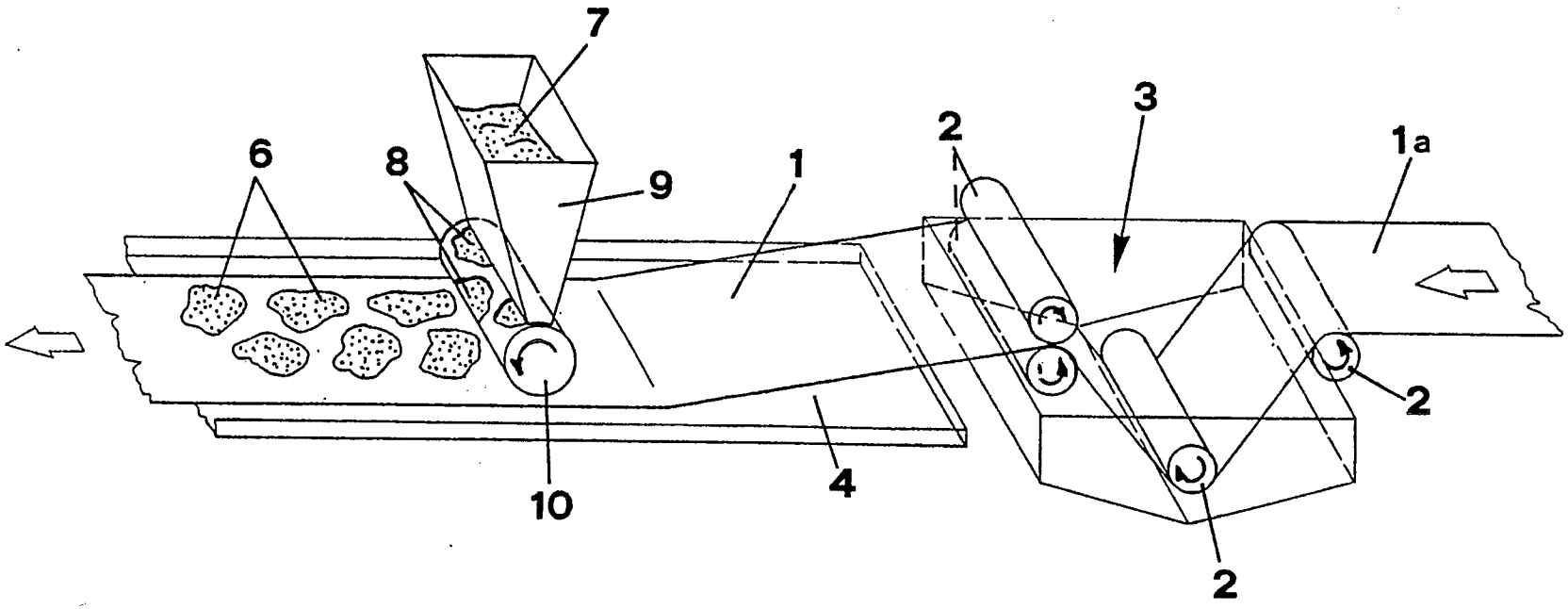
FIG. 1 shows the apparatus in a first embodiment.

With reference to the drawings, 1 demotes a tarred membrane, illustrated during its continuous advancement movement along the production line.

FIGS. 1, 2, 4, 7 and 8 show how the reinforcement strip 1*a* of the membrane (constituted by a material such as glass felt, but not polyester fabric, other glass fabric, metal sheets and/or combinations of the above) is made to pass, by means of rollers 2, into an impregnation bath 3 containing tar (not illustrated) kept at a high temperature.

Downstream of the impregnation bath 3 the membrane 1, now impregnated and covered with tar, passes to a cooling bath 4 containing water (not illustrated) on which it floats due to its lower specific gravity and/or the traction force it is subject to.

Obviously, at the first tract of the cooling bath 4 the tarred membrane 1 is still hot and its surface is still soft and sticky. This is the best place to position the means for applying solid particles of the apparatus. Alternatively, if it were not possible or convenient to position the means for applying solid particles of the apparatus at the first tract, it could be located in another zone of the production line as long as just upstream of the apparatus application zone there were a heating station, which might be constituted by a battery of burners 5 arranged transversally with respect to the membrane 1 (see FIG. 3), or a tar spreading station, or a mixing station of melted polymer-tar or adhesive substances.

The remainder of the apparatus including the solid particles applying means, in its different embodiments can, therefore, be positioned immediately downstream of the impregnation bath 3 or the heating station 5 or the tar or adhesive spreading station.

The decorations 6 are realized by the use of solid particles 7 in the form of granules or sands or scales (any material), which granules adhere to the still-sticky surface of the membrane 1.

The decorations 6 are realized by a solid particles applying means (which structure will be better described) hereinafter) provided with shapes 8 having the same form as the decorations 6 to be realized on the membrane 1. The means for applying solid particles is arranged below a hopper 9 containing the solid particles 7, such that the particles 7 fall by force of gravity from the mouth of the hopper 9 on to the means for applying solid particles and thence from the shapes 8 made in the solid particles applying means on to the transiting membrane 1, forming the decorations 6 on the membrane 1.

The solid particles applying means can exhibit differing structures and conformations according to the various operative needs. The following are some of the possible embodiments.

Figure 5:
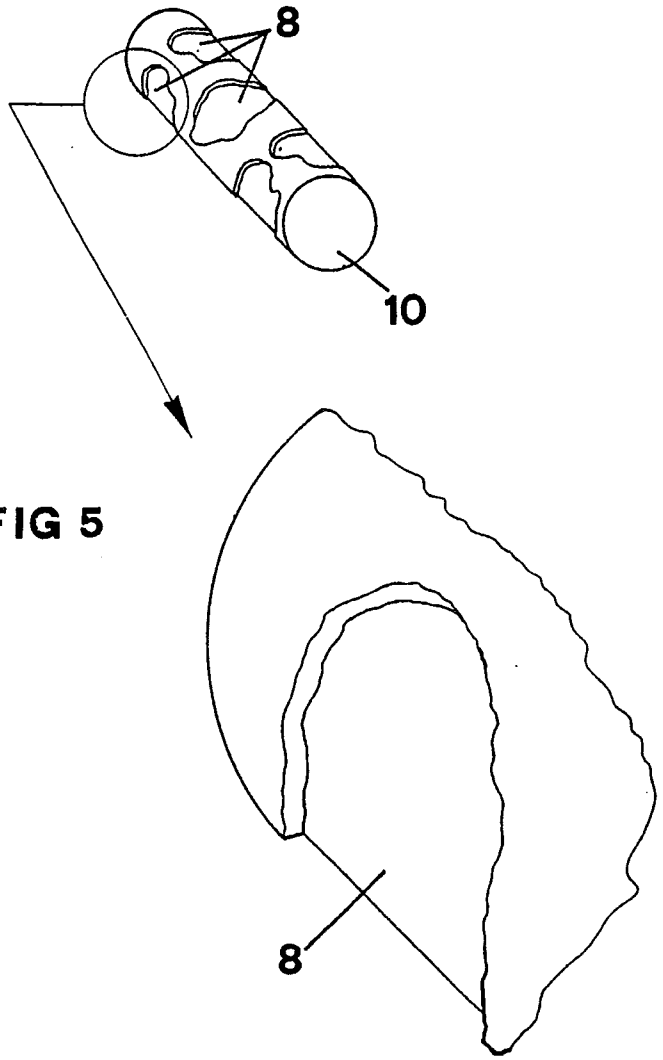

In FIG. 1, the solid particles applying means is constituted by a motorized roller 10 rotating about its own axis, arranged transversally to the advancement direction of the membrane 1 and above it (at a distance of a few centimeters). As it rotates it just touches the hopper 9 outlet mouth and the solid particles 7 thus deposit in the shapes 8 on the solid particles applying means. Each shape 8 in this case is constituted by a recess (clearly visible in FIG. 5) cut into the roller 10 surface. Worthy of note is the fact that when the shapes 8 used are to be changed it is sufficient to substitute the skin of the motorized roller 10, not the entire cylinder 10 assembly.

Figure 2:
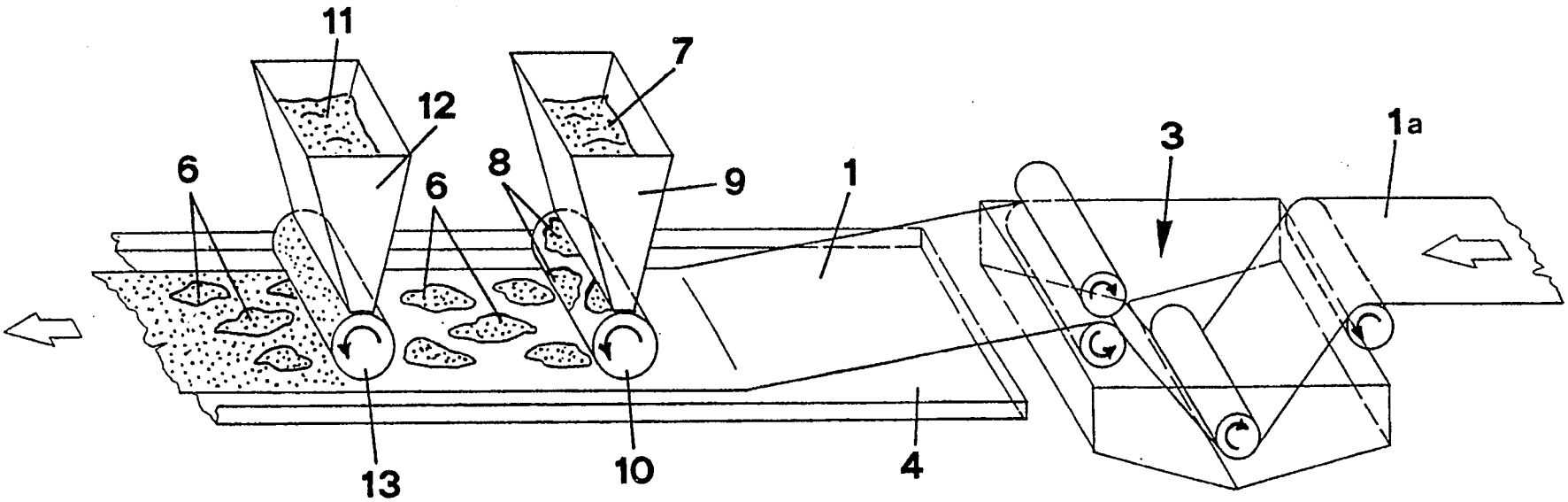
FIG. 2 shows the apparatus of FIG. 1 and downstream of it a known-type apparatus for placing a layer of grit on the membrane to protect it.
Figure 3:
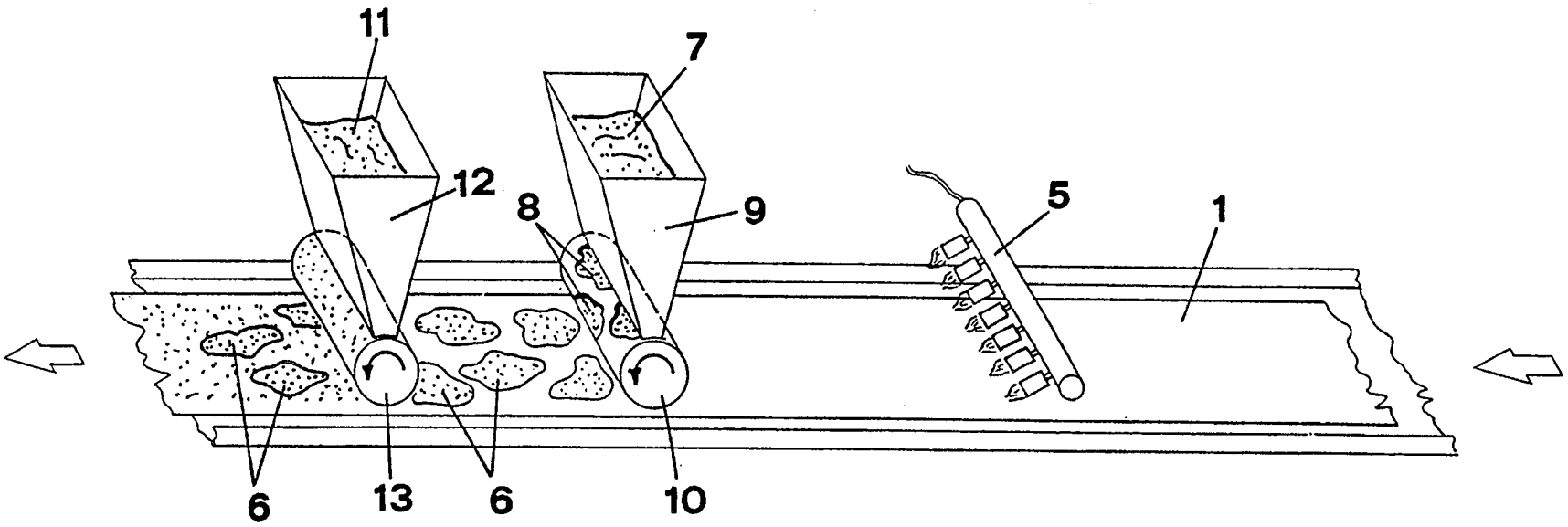
FIG. 3 shows the apparatus of the invention positioned immediately downstream of a membrane heating station instead of downstream of the impregnation bath.

FIGS. 2 and 3 show how a particle 11 distributor is positioned downstream of the motorized roller 10, which particles 11 are different from the solid particles 7 in some way (in color, for example). The distributor uniformly spreads the particles 11 on the membrane 1 coming from the motorized roller 10, and obviously the particles 11 only adhere on the membrane 1 parts that have not already been decorated by the shapes 8. This last operation has the dual function of improving the aesthetic effect of the finished tarred surface and of protecting the entire membrane 1, not just the decorated parts, from ultraviolet weathering.

Obviously the particle 11 distributor can be positioned downstream of the solid particles applying means of the apparatus, in various way and according to needs. In the accompanying drawings it has been represented only in some cases wherein the decorations 6 are deposited on the black surface of the tarred felt of the membrane 1.

In FIGS. 2 and 3, the particle 11 distributor comprises a hopper 12 which unloads the particles 11 on to an underlying rotating drum 13 positioned above the membrane 1.

Figure 4:
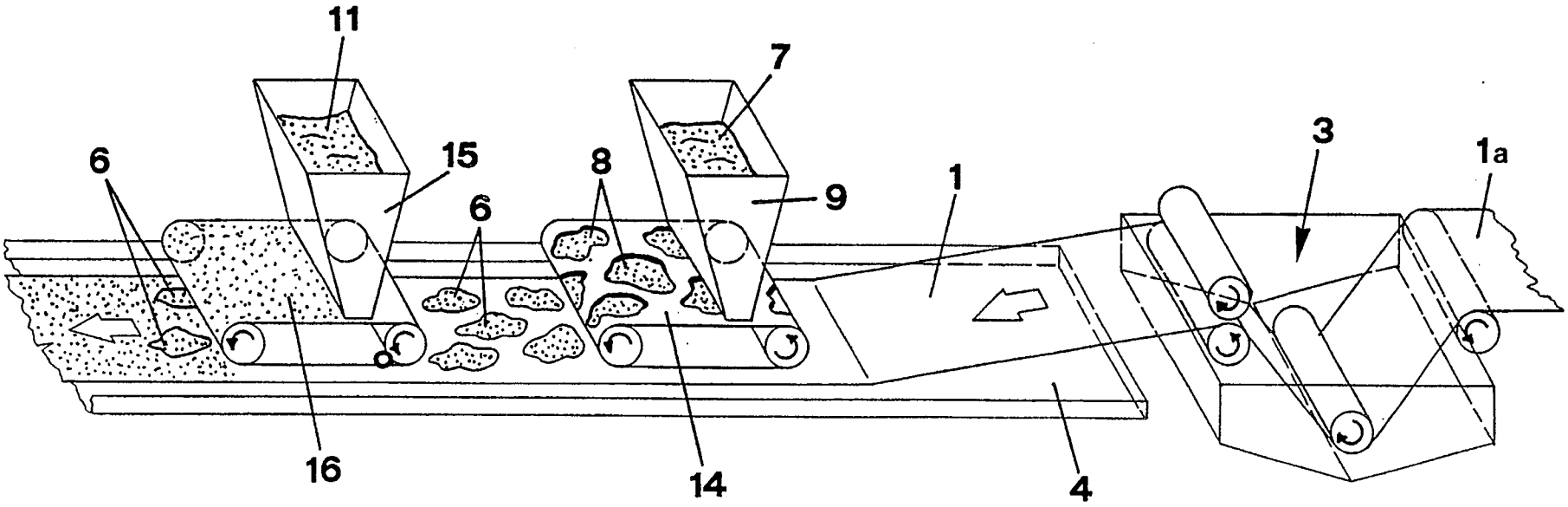
FIG. 4 shows a similar situation to that of FIG. 2, where the apparatus is shown in a second embodiment.

In FIG. 4, solid particles applying means is constituted by a ring-wound motorized continuous conveyor belt 14 arranged above the membrane 1 and distanced at a few centimeters from it.

Figure 6:
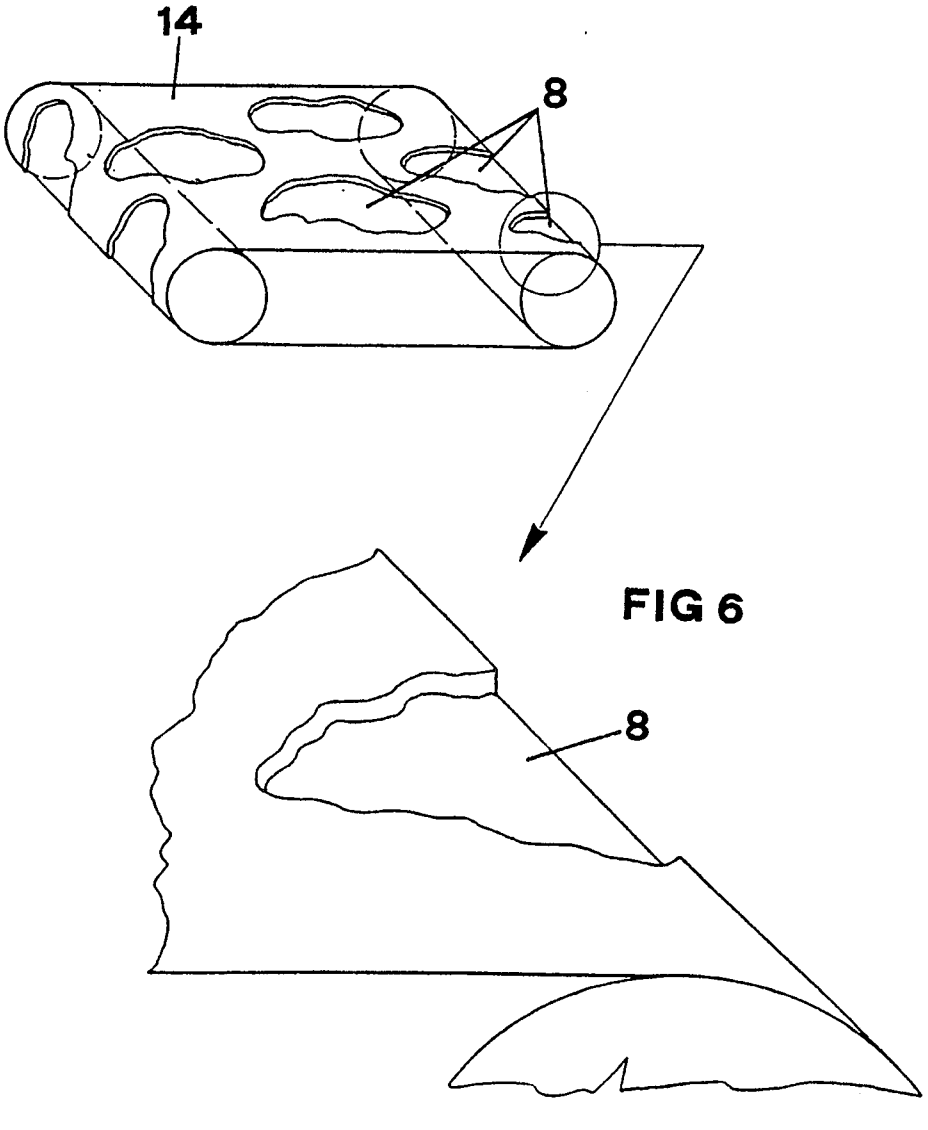
FIGS. 5 and 6 show an enlarged view of details of the surfaces laid by the solid particles applying means of FIG. 1 and of FIG. 4.

In the above embodiment the shapes 8 are also constituted by recesses (evidenced in FIG. 6) in which the particles 7 collect through force of gravity when the motorized continuous conveyor belt 14 touches the outlet mouth of the hopper 9.

In the example of FIG. 4, the particle 11 distributor is constituted by a hopper 15 which unloads the particles 11 on an underlying ring-wound motorized continuous conveyor belt 16 positioned above the membrane 1 and distanced by a few centimeters from it.

In the embodiment of FIG. 4 it would have been possible to use the particle 11 distributor of FIG. 2, the two types of particle 11 distributor shown in FIGS. 2 and 4 being largely interchangeable.

Figure 7:
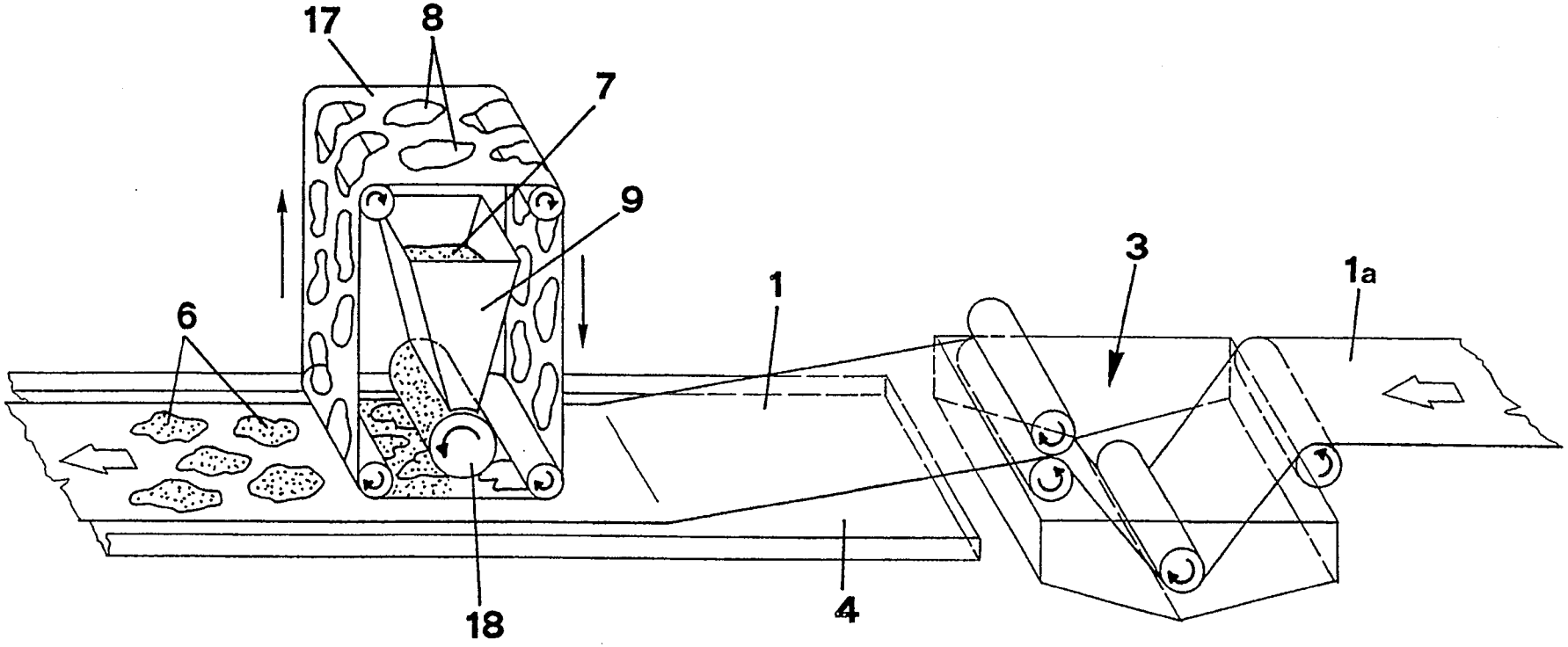
FIG. 7 shows the apparatus of the invention in a third embodiment.

In FIG. 7, solid particles applying means is a motorized continuous ring-wound conveyor belt 17 positioned above the membrane 1 at a distance of a few centimeters from it. A motorized rotating roller 18 is positioned between the continuous belt 17, where the shapes 8 are formed by through holes, and the outlet mouth of the hopper 9, which roller 18 just touches the outlet mouth (obviously a conveyor belt could be use instead of the roller 18), such that a more even distribution of the particles 7 can be obtained on the continuous belt 17 and therefore the membrane 1.

Figure 8:
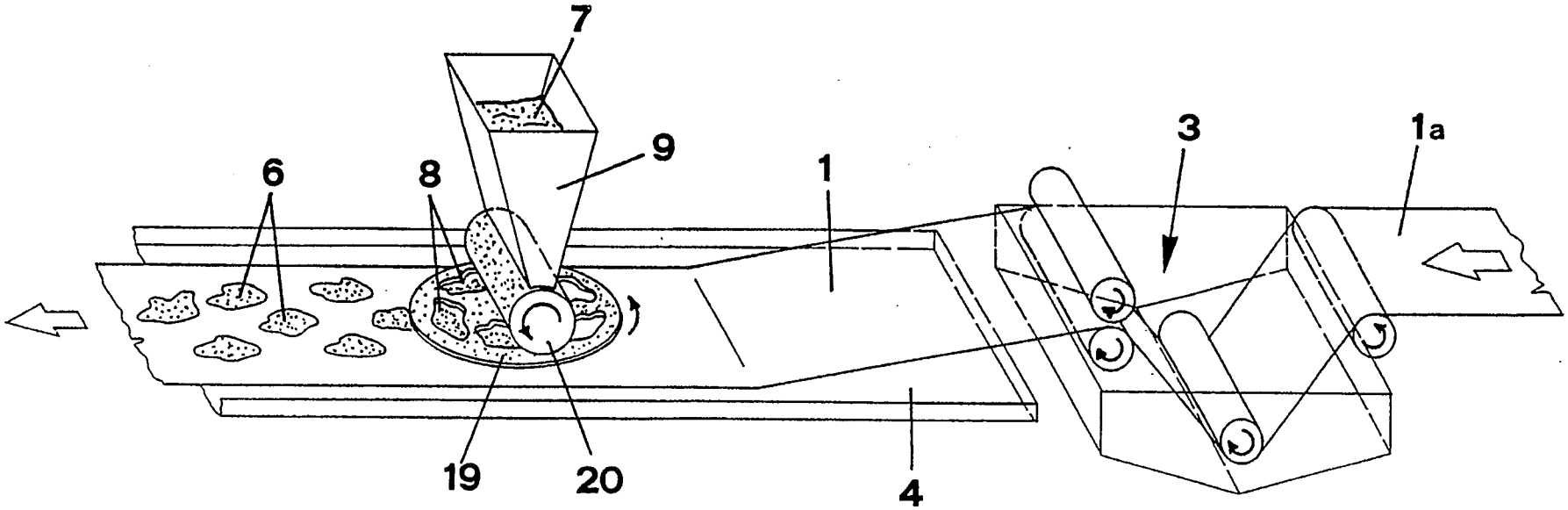
FIG. 8 shows the apparatus of the invention in a fourth embodiment.

FIG. 8 shows a further embodiment of the apparatus, wherein solid particles applying means is constituted by a motorized plate 19 arranged above the membrane 1 and rotatable about an axis perpendicular to the membrane 1. In the motorized plate 19 the shapes 8 are constituted by through holes, through which the solid particles 7 coming from the surface of a motorized roller 20 (which just scrapes the outlet mouth of the hopper 9) fall on to the membrane 1.

The rotation or movement sense of the various components of the apparatus (rollers 10, 13, 18, 20, plate 19 and belts 14, 16, 17) can be imposed according to need such as to optimized the particle 7 or 11 distribution over the membrane 1 surface.

What is claimed:

1. An apparatus for making decorations (6) on the surface of a membrane used for making surface coverings, comprising:

impregnation means (3) for impregnating a membrane to form an impregnated membrane;

at least one hopper downstream of said impregnation means and for containing solid particles, and having an outlet mouth for dispensing the solid particles;

at least one applicator means for applying the solid particles in a decorative pattern on the impregnated membrane, said applicator means being disposed below said outlet mouth of said hopper and positioned to receive the impregnated membrane traveling from said impregnation means in a membrane advancing direction, said applicator means being provided with decorative shapes identical to decorations to be applied onto the impregnated membrane so that solid particles falling from said outlet mouth of said hopper onto said applicator means are applied as decorations adhering to the surface of the impregnated membrane.

2. An apparatus as recited in claim 1, wherein said applicator means comprises a motorized roller (10) rotating about its own axis and arranged transversely to and above said advancing direction of the membrane (1) and lightly touching (10) said outlet mouth of said hopper (9), said motorized roller having a surface on which a plurality of recessed shapes (8) are disposed corresponding to said decorative shapes.

3. An apparatus recited in claim 1, wherein said applicator means comprises a ring-wound motorized continuous conveyor belt (14) arranged above the membrane (1) and touching said outlet mouth of said hopper (9), said ring-wound motorized continuous conveyor belt (14) having a surface on which a plurality of recessed shapes (8) are disposed corresponding to said decorative shapes.

4. An apparatus as recited in claim 1, wherein said applicator means for applying solid particles comprises:

a motorized ring-wound continuous conveyor belt (17) having a plurality of shaped through holes (8) corresponding to said decorative shapes and being positioned above the plane of movement of the membrane (1); and a rotating roller (18) disposed between said motorized ring-wound continuous conveyor belt (17) and said outlet mouth of said hopper (9), said rotating roller (18) touching said outlet mouth.

5. An apparatus as recited in claim 1, wherein said applicator means comprises a plate (19) disposed parallel to the plane of movement of the membrane (1) below said applicator means, said plate being rotatable about a perpendicular axis to said plane, said plate having a plurality of shaped through holes corresponding to said decorative shapes.

6. An apparatus as recited in claim 5, wherein said applicator means further comprises a motorized rotating roller (20) disposed between said plate (19) and said hopper (9), said motorized rotating roller (20), rotating about its own axis and transversely to said plane of movement of the membrane and lightly dragging against said outlet mouth of said hopper.

7. An apparatus as recited in claim 1, further comprising a particles distributor (11) disposed downstream of said applicator means in a direction from said impregnation bath to said applicator means, said particles distributor spreading the particles uniformly on the membrane (1).

8. An apparatus as recited in claim 7, wherein said particles distributor (11) comprises:

a ring-wound motorized continuous conveyor belt (16) disposed above the plane of movement of the membrane; and a hopper, said hopper of said particles distributor disposed above said ring-wound motorized continuous conveyor belt and unloading the solid particles onto said ring-wound motorized continuous conveyor belt for spreading uniformly on the surface of the membrane.

9. An apparatus as recited in claim 1, further comprising a heating station (5) for heating the membrane.

10. An apparatus as recited in claim 10, wherein said heating station (5) comprises a plurality of burners disposed above the plane of movement of the membrane.

11. An apparatus as recited in claim 1, further comprising a spreading station for spreading tar, a mixture of tar and a polymer, or an adhesive substance on the membrane.

* * * * *